US007731186B2

(12) United States Patent
Krause et al.

(10) Patent No.: US 7,731,186 B2
(45) Date of Patent: Jun. 8, 2010

(54) SHEET TRANSPORT APPARATUS AND METHOD FOR TRANSPORTING A SHEET IN A PRINTING MACHINE

(75) Inventors: Hans-Otto Krause, Eckernfoerde (DE); Frank-Michael Morgenweck, Kiel (DE); Domingo Rohde, Kiel (DE)

(73) Assignee: Eastman Kodak Company, Rochester, NY (US)

( * ) Notice: Subject to any disclaimer, the term of this patent is extended or adjusted under 35 U.S.C. 154(b) by 70 days.

(21) Appl. No.: 11/758,052

(22) Filed: Jun. 5, 2007

(65) Prior Publication Data

US 2008/0001347 A1 Jan. 3, 2008

(30) Foreign Application Priority Data

Jun. 6, 2006 (DE) ..... 10 2006 026 835
May 29, 2007 (DE) ..... 10 2007 024 945

(51) Int. Cl.
*B65H 29/30* (2006.01)

(52) U.S. Cl. ..... 271/193; 271/197; 271/194; 271/195

(58) Field of Classification Search ..... 271/193, 271/197, 276, 194, 195, 90, 97, 98
See application file for complete search history.

(56) References Cited

U.S. PATENT DOCUMENTS 3,698,706 A * 10/1972 Mihojevich et al. ..... 271/9.11
3,966,199 A * 6/1976 Silverberg ..... 271/275
4,022,366 A * 5/1977 Rooney ..... 226/91
4,252,307 A * 2/1981 Korte ..... 271/4.01
5,467,180 A * 11/1995 Malachowski et al. ..... 399/381
5,502,545 A * 3/1996 Tsuruoka ..... 399/21
5,732,623 A 3/1998 Compera et al.
6,092,800 A 7/2000 Compera et al.
6,405,914 B1 * 6/2002 Broom et al. ..... 226/95
6,406,017 B1 * 6/2002 Yaneda ..... 271/276
6,745,001 B2 6/2004 Wright et al.
6,993,278 B2 1/2006 Bartscher et al.
6,997,549 B2 * 2/2006 Howarth et al. ..... 347/104
7,052,126 B2 * 5/2006 Suzuki et al. ..... 347/104
7,059,598 B2 6/2006 Hagemann et al.
2005/0077171 A1 4/2005 Hagemann et al.

* cited by examiner

*Primary Examiner*—Patrick Mackey
*Assistant Examiner*—Luis Gonzalez
(74) *Attorney, Agent, or Firm*—Donna P. Suchy

(57) ABSTRACT

A sheet transport method and apparatus are provided for improving the handling of sheets control in printing systems. This automatic sheet transport system and method includes transporting a sheet in the printing machine via a transport belt circulating in a direction of transport, wherein a sheet contact surface of the circulating transport belt is made of an electrically non-conducting material. The method includes placing a sheet on an area of the transport belt and sucking or holding the sheet to the circulating transport belt by a negative pressure applied through the belt and also applying electrical charges to generate electro-static holding forces between the circulating transport belt and the sheet.

23 Claims, 4 Drawing Sheets

SHEET TRANSPORT APPARATUS AND METHOD FOR TRANSPORTING A SHEET IN A PRINTING MACHINE

CROSS REFERENCE TO RELATED APPLICATIONS

This application claims priority from German Patent Application No. 102006026835.0 filed Jun. 6, 2006, and German Patent Application No. 102007024945.6 filed May 29, 2007.

FIELD OF THE INVENTION

The present application relates to a method and an apparatus for transporting a sheet in a printing machine, wherein the sheet is transported via a circulating transport belt. The present application further relates to a method for printing on a sheet and a printing machine in combination with the method and the apparatus for transporting a sheet, respectively. The printing machine is preferably a digital printing machine, which may particularly use an electro-photographic printing process.

BACKGROUND OF THE INVENTION

In the printing technology, different methods and apparatuses for transporting a sheet in a printing machine are known. DE 10113885 A1, corresponding to U.S. Pat. No. 6,993,278, for example shows a transport apparatus having a circulating transport belt, which is air-permeable, in order to allow sucking sheets via negative pressure to the transport belt. The force with which a respective sheet is adhered to the transport belt depends on the permeability of the suction belt, as for example defined by the size and the amount of through openings there through, as well as the amount of negative pressure applied. Inasmuch as the number and the size of the through openings should usually be kept small, in order to avoid influencing processes, which may act on the sheet being transported, a sufficient holding force may not be provided in all cases.

In DE 10319846 A1, corresponding to U.S. Pat. No. 6,745,001, an alternative transport apparatus having a circulating transport belt is described. In this transport apparatus the transport belt is electro-statically charged via a corona facing the transport belt, in order to adhere a sheet on that transport belt by electro-static forces. In those areas, in which a sheet contacts a thus electro-statically charged transport belt, a large holding force is provided. If the sheet, however, is not flat on the transport belt, when that charge is applied, the holding force only acts in the contact areas. If the sheet lies on the transport belt in a bowed manner, the electro-static forces acting in the contact areas would hold the sheet during the transportation in this bowed manner. This could substantially influence any process to be performed on the sheet during the transportation, such as for example printing an image on the sheet.

SUMMARY OF THE INVENTION

The present application is directed to overcome at least some of the disadvantages of the previously described transport apparatuses. To achieve this, a method for transporting a sheet in a printing machine having a transport belt of the suction belt type, which circulates in a transport direction and which has a sheet contact surface made from an electrically non-conductive material is provided. The method includes placement and removal. When placing a sheet on the circulating transport belt, the sheet is placed on the belt in a substantially flat manner in order to contact a large area before applying to the circulating transport belt a negative pressure to suck the sheet to the belt and electrical charges in an area of the circulating transport belt where the sheet is to be held before printing. By so holding the sheet to the transport belt a better electro-static holding force is generated between the circulating transport belt and the sheet. Later, in a related manner the electro-static holding forces are reduced to help remove the sheets. Reducing the electro-static holding forces and at least partially neutralizing the electrical charges after the electrical charges are applied and after the sheet is moved over a predetermined distance on the circulating transport belt assists in the removal of the sheet. During the predetermined movement between the application of the electrical charges and the neutralization thereof, the sheet may also be sucked to the transport belt. Alternatively, during at least a portion of this predetermined movement between the application of the electrical charges and the neutralization thereof, the sheet may not be sucked to the belt. In this case, the sheet may be again sucked to the transport belt in the area of the charge neutralization.

In order to promote removing the sheet from the transport belt, in accordance with one example, pressurized air may be applied to the sheet through the transport belt. The pressurized air may particularly be applied after the neutralization of the charges. The application of pressurized air may specifically occur in a deflection area of the transport belt. In this case the pressurized air could be applied via a guide roller for the transport belt.

In order to avoid uncontrolled movement of the sheet away from the transport belt during the application of pressurized air, movement of the sheet in a direction perpendicular to an outer surface of the transport belt is limited. In one example the sheet is removed from the transport belt by means of lifting elements, which locally extend through the transport belt.

BRIEF DESCRIPTION OF THE DRAWINGS

In the following different examples of the application are described with reference to the drawings.

DETAILED DESCRIPTION OF THE INVENTION

Figure 1:
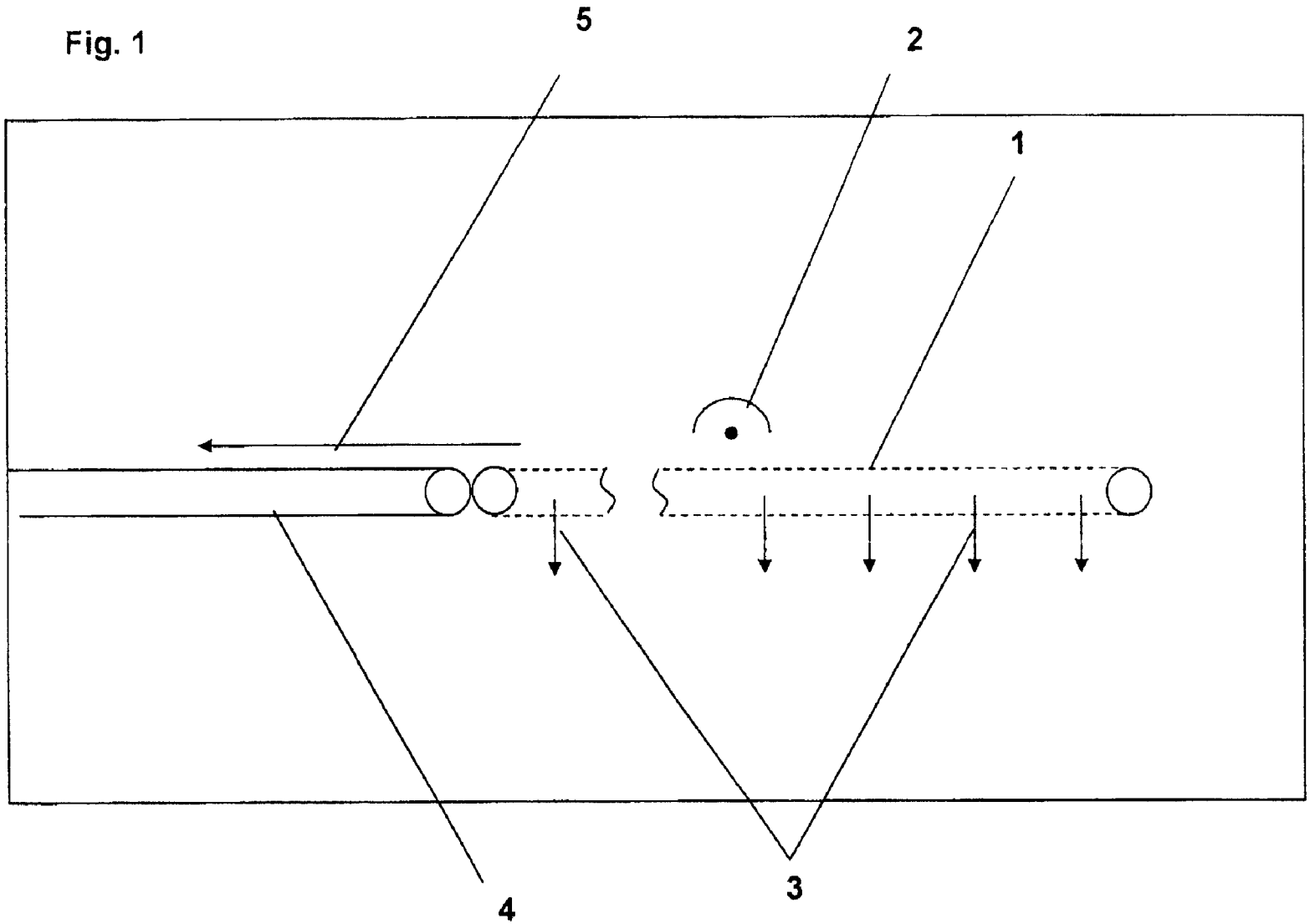
FIG. 1 shows a schematic side-view of part of a transport apparatus according to the first example.

The present application is directed to overcome at least some of the disadvantages of the previously described transport apparatuses. To achieve this, a method for transporting a sheet in a printing machine having a transport belt of the suction belt type, which circulates in a transport direction and which has a sheet contact surface made from an electrically non-conductive material is provided, the method comprising, placing a sheet on the circulating transport belt, holding the sheet to the circulating transport belt via negative pressure and applying electrical charges to the circulating transport belt in an area, in which the sheet is sucked to the transport belt, whereby an electro-static holding force is generated between the circulating transport belt and the sheet. Due to the fact that the sheet is first sucked to the circulating transport belt it can be assured that the sheet is substantially flat on the transport belt and contacts the same in a large area. During the subsequent application of the electrical charges, good electro-static holding forces can be achieved, as the sheet smoothly contacts the transport belt and a large contact area is present, in which the electro-static forces may act.

In order to reduce the electro-static holding forces for a subsequent removal of the sheet, the electrical charges may be at least partially neutralized after the electrical charges applied and after the sheet is moved over a predetermined distance on the circulating transport belt. During this predetermined movement between the application of the electrical charges and the neutralization thereof, the sheet may also be sucked to the transport belt. Alternatively, during at least a portion of this predetermined movement between the application of the electrical charges and the neutralization thereof, the sheet may not be sucked to the belt. In this case, the sheet may be again sucked to the transport belt in the area of the charge neutralization.

In order to promote removing the sheet from the transport belt, in accordance with one example, pressurized air may be applied to the sheet through the transport belt. The pressurized air may particularly be applied after the neutralization of the charges. The application of pressurized air may specifically occur in a deflection area of the transport belt. In this case the pressurized air could be applied via a guide roller for the transport belt.

In order to avoid uncontrolled movement of the sheet away from the transport belt during the application of pressurized air, movement of the sheet in a direction perpendicular to an outer surface of the transport belt is limited. In one example the sheet is removed from the transport belt by means of lifting elements, which locally extend through the transport belt.

The application also describes a method for printing a sheet in a printing machine, wherein the sheet is transported past a printing module in the previously described manner, and wherein during the transport a print medium, such as for example toner or ink, is applied to the sheet via the print module. In one example application of the print media is applied via an electro-photographic printing process. In this case, during the application of the print medium, the sheet is not sucked to the transport belt via negative pressure, but is held thereon by electro-static holding forces.

In an alternative example the application of the print medium occurs via an inkjet printing process. In this printing process the sheet may be held on the transport belt during the application of the print medium by electro-static holding forces and suction force. In this case, it is possible that the sheet is not held on the transport belt by negative pressure in the specific area, in which the print medium is supplied to the sheet, but only adjacent hereto.

The application further describes a transport apparatus for transporting a sheet in a printing machine, wherein the transport apparatus comprises a transport belt of the suction belt type, a drive unit for moving the transport belt along a closed loop transport path, a suction unit adjacent the transport belt, the suction unit being arranged to be able to suck a sheet, which is present on the transport belt to the transport belt, and a charge unit for applying electrical charges to the transport belt, wherein the charge unit is arranged to apply the charges to the transport belt in the area of the suction unit.

In order to promote removal of the sheet from the transport belt, a neutralizing unit for neutralizing electrical charges on the transport belt may be provided, wherein the neutralizing unit is arranged downstream with respect to the charge unit along the closed loop transport path.

The suction unit provided in the transport apparatus may extend along the closed loop transport path over a portion extending from the charge unit to the neutralizing unit. Alternatively a further suction unit may be provided, which is arranged in such a manner that is able to suck a sheet present on the transport belt to the transport belt, and which is arranged downstream with respect to the one suction unit along the closed loop transport path. The further suction unit may be arranged in an area, in which the neutralizing unit neutralizes charges on the transport belt.

In one example, a blowing unit may be provided, which is arranged in such a manner, that it may blow air through the transport belt onto a sheet placed thereon. The blowing unit may be arranged downstream with respect to the neutralizing unit along the closed loop transport path. In particular, the blowing unit may comprise a roller in the shape of a hollow shaft having outwardly facing through openings, also known as air permeable openings, the transport belt being guided around the roller. Thus, in the area, where the transport belt is guided around the roller, secure removal of the sheet may be achieved. A sheet guide element may by provided, which is arranged adjacent the surface of the transport belt facing away from the blowing unit. The sheet guide element may avoid uncontrolled movement of the sheet while air is blown thereon. The sheet guide element may be arranged with a distance of approx. 0.5 cm with respect to the surface of the transport belt facing away from the blowing unit.

In one example the transport belt has through openings and a lifting element having protrusions is provided, wherein the lifting element is arranged in such a manner, that the protrusions may locally extend through the through openings of the transport belt. In this manner a sheet on the transport belt may be locally lifted by the protrusions in order to remove the sheet. Such a lifting unit may be arranged along the closed loop transport path downstream with respect to the neutralizing unit. The lifting unit may for example comprise a rotatable roller having the protrusions formed on an outer circumference thereof, wherein the transport belt is guided around the roller. Thus, in an area where the transport belt is guided around the roller, secure removal of the sheet may be ensured. In one example the transport belt has through openings and each through opening has a sectional area of approx. less than 1 $mm^2$.

The application further describes a printing machine having at least one print module and a transport apparatus of the previously described type, wherein the printing module is arranged such that one area thereof for applying a print medium is directed onto the transport belt.

It is noted that for applying the charges to the transport belt an electrical DC-field may be used and for the neutralization of charges an electrical AC-field may be used. Furthermore, the application of charges may be achieved by a so-called scorotron having a screen.

In the following specification terms like for example "upper" or "lower", "left" or "right" are used for a better understanding of the examples shown in the drawings, and these terms are in not to be construed to limit the application.

FIG. 1 shows a side view of a section of an exemplary transport arrangement in the region of the application of charges.

The transport arrangement includes an air-permeable transport belt 1 for the application of charges, said transport belt extending beneath an indicated corona device 2, and receives not specifically illustrated sheets which are to be tacked electrostatically to the transport belt 1 in this region, so that they may be transported further. In order to aid this tacking, a downwardly directed negative pressure may be generated through the transport belt 1, said belt being indicated in a dashed line to illustrate its permeability to air, said negative pressure being indicated with arrows 3 and ensuring that each sheet is in flat, smooth and tight contact with the transport belt 1. If a particular sheet is tacked securely to the transport belt 1 in an electrostatic manner, this sheet can be transferred to a subsequent transport belt 4 for continued transport in the direction of an arrow 5, where it is also held in an electrostatic manner, whereby, however, this additional transport belt 4 need not necessarily also be air-permeable, this being illustrated by a solid line.

Figure 2:
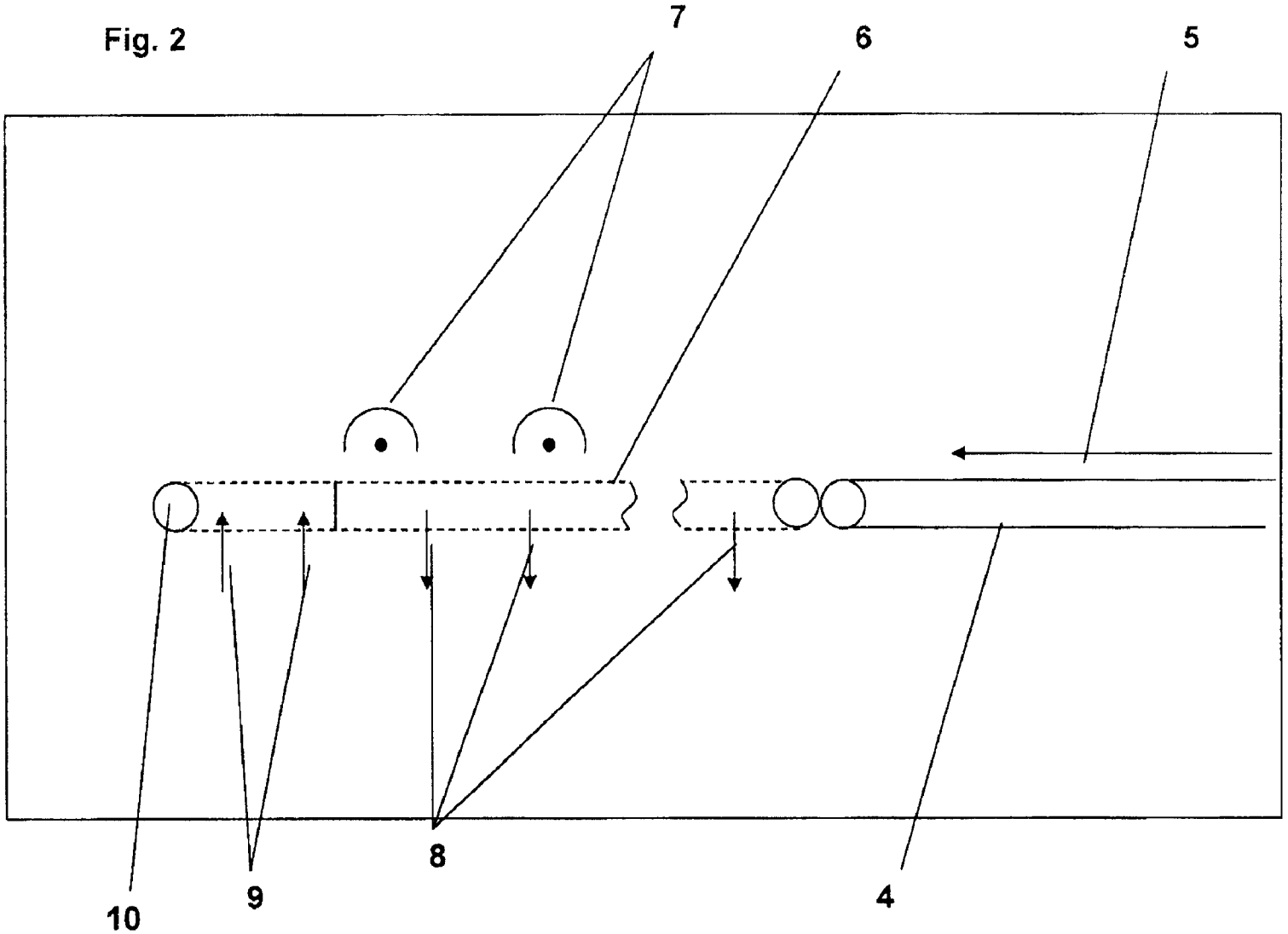
FIG. 2 shows a schematic side-view of a further part of a transport apparatus according to the first example.

FIG. 2 shows a section of the transport arrangement in the region of the neutralization of charges.

The sheet that is still tacked can be transferred from the transport belt 4 to a subsequent transport belt 6, which is also air-permeable, and can be held there in an electrostatic manner, whereby the electrostatic forces are neutralized there by the corona devices 7, while the sheet can initially still be sucked in the direction of the arrows 8 so that it remains flat. Subsequently, however, the sheet can then be blown at from underneath through the transport belt 6 in the direction of the arrows 9 and be lifted in order to aid the Transport belts 1, 4 and 6 are shown and described as separate Transport belts, the skilled person will realize that a single Transport belt may be provided, to which at separate sections thereof a negative or positive pressure may be applied, in order to suck the sheet to the belt or to blow thereat through the belt.

In this manner, a printed printing sheet may be detached in a particularly careful manner from an electrostatic transport belt 6.

In particular, with thin and insulating sheet substrates, more problems of substrate damage and transport jams could arise, if the substrate were to be detached from an electrostatic web by means of squeegees. And in particular at high velocities, the detacking reliability may be reduced.

In accordance with the above example, a sheet is detacked in an order that is reversed to the order used for tacking the sheet, inasmuch as the previously applied electrostatic charge is first neutralized by so-called "detack" corona devices 7, and the sheet is subsequently detacked from the transport belt 6 by excess pressure and/or mechanical "rams" which push through the transport belt 6.

An additional advantage of the inventive combination of vacuum and electrostatic transport is that the transport is insensitive to moisture released by the sheet substrates. High moisture content in the substrate or released moisture can neutralize the electrostatic retaining forces due to increased conductivity. In accordance with the invention, however, the substrate is additionally held by the vacuum, and, to a certain extent, moisture is carried away better.

In addition, the following modifications are conceivable in accordance with respect to the above examples:

When using an air-permeable transport belt having holes formed therein, the diameter of the holes can be changed as needed. As an example, processes requiring a highly homogeneous substrate support surface such as, for example, the electrostatic transfer of toner powder in electro-photography, the holes should be selected as small as possible relative to the web diameter. Also, a porous, air-permeable transport belt without holes would be conceivable.

Also detachment of the sheets could be implemented in a simple manner by providing a structure on a rear deflecting roller, viewed in direction of transport, the structure having mechanical elevations matching the hole pattern of the perforated belt. Those elevations must be thicker than the thickness of the web in order to be able to detach the sheet.

Analogous to the previous situation, it would also be possible to emboss a hole pattern in the rear deflecting roller 10, said hole pattern matching the hole pattern of the web, and to design the roller as a hollow shaft, so that an excess pressure may be applied to the hollow shaft. As a result, the exiting air detacks the sheet. In this arrangement, the raised structure can be incorporated in the air line, for example in that projections or the like are configured as hollow air guides.

In order to prevent the sheet, which is blown at from underneath and thus lifted off the transport belt, from deviating too much from the ideal transport path, a baffle or a nozzle, to which pressurized air is applied, can be provided above the detaching point, said baffle or nozzle pressing or guiding the sheet back towards the transport path.

Figure 3:
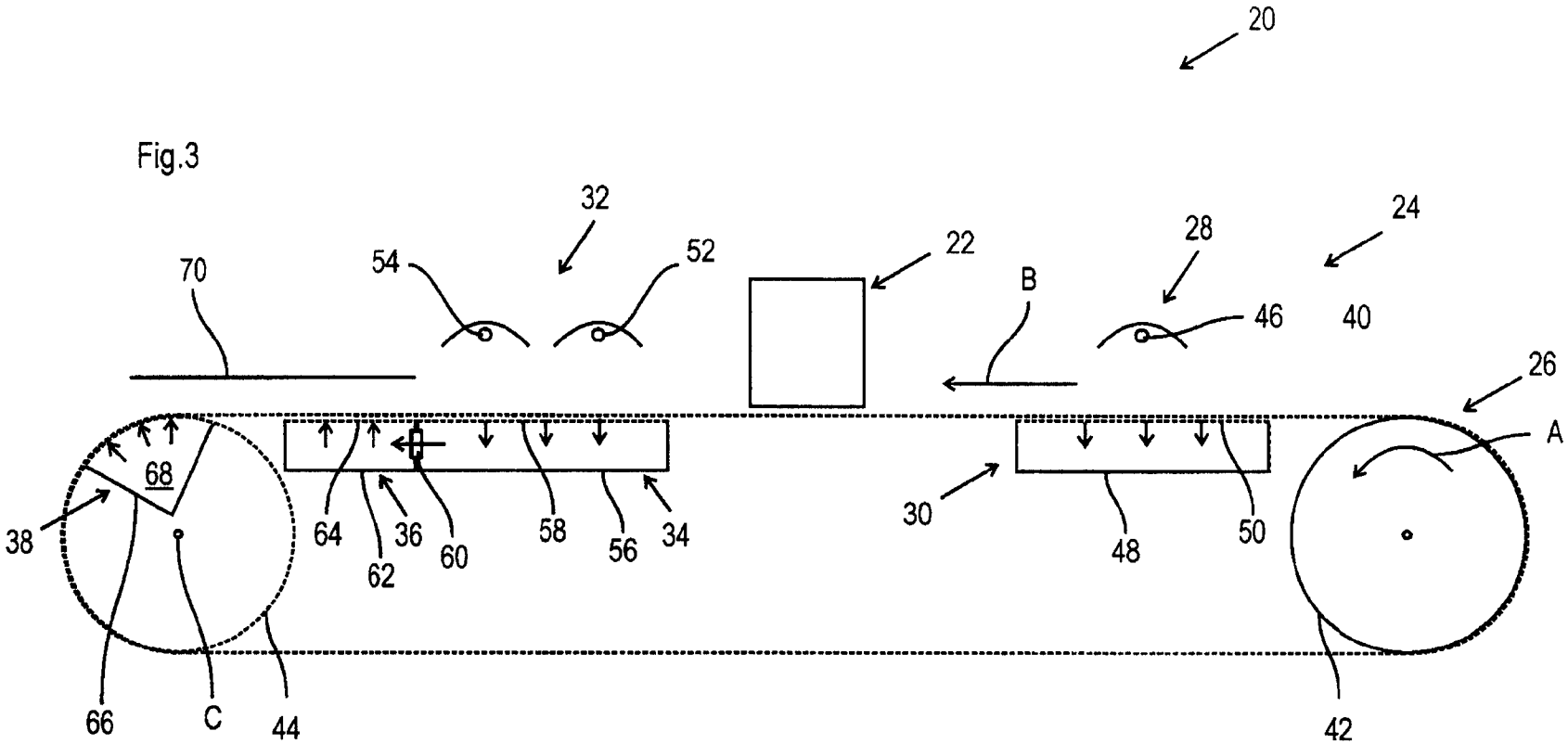
FIG. 3 shows a schematic side-view of a printing machine having a transport apparatus in accordance with the second example.

FIG. 3 shows a schematic side view of a printing machine 20 having a print module 22 and an alternative transport apparatus 24.

The printing module 22 is of any suitable type for applying a print medium to a sheet (not shown), such as a paper sheet, which is moved past the printing module. In the following description, we assume that the printing module of FIG. 3 is a Printing module using an electro-photographic printing process. Even though, a single printing module is shown in FIG. 3, several printing modules may be provided for a multi-color print. The print modules could be arranged adjacent to each other, to sequentially print different color images onto the sheet on the transport apparatus. It is also possible that the print module applies the different color images first on a transfer element, and that these combined color images are subsequently transferred to a sheet on said transport apparatus 24.

The transport apparatus 24 has a transport unit 26, a charge unit 28, a first suction unit 30, a neutralizing unit 32, a second suction unit 34, a first blowing unit 36 and a second blowing unit 38.

The transport unit 26 includes a transport belt 40, which is guided around two separated guide rollers 42, 44.

The transport belt 40 is of the suction belt type, i.e. it is at least partially air permeable, in order to allow suction of an object thereon towards the belt by negative pressure. The air permeability may for example be provided by through openings in the shape of perforations. Such through openings preferably each have a cross-sectional area of smaller than approx. 1 $mm^2$ and in particular of smaller than approx. 0.5 $mm^2$. Alternatively it is also possible to use a porous belt material, in order to achieve air permeability. It is also possible to use a meshed fabric material for the transport belt.

As shown in FIG. 3 the transport belt 40 is formed into an endless loop, which is guided around the guide rollers 42, 44. The transport belt is of a material having elastic properties. Furthermore the transport belt is made of an electrically non-conductive material. Alternatively, only the outer surface of the transport belt may be coated with an electrically non-conductive material.

The deflecting roller 42 is coupled to a drive unit (not shown), in order to rotate the transport roller in the direction of the arrow A according to FIG. 3. Due to this rotations, the transport belt guided around the guide rollers is moved into a direction of transport as imitated by arrow D.

The guide roller 44 is formed as a hollow shaft having a hollow cylindrical body, which is freely journalled around an axis of rotation in any suitable manner. Alternatively it is also possible to couple the guide roller 44 with a drive unit, and to freely journal the guide roller 42, or to couple those guide rollers 42, 44 to a drive unit. The side portions of the hollow cylindrical body may be closed by end walls, which are not shown. The hollow cylindrical body has a plurality of through openings, also referred to as comprising air permeable openings, in the circumferential direction thereof in order to allow air to pass there through, as will be explained in more detail herein below.

The charge unit 28 is arranged above the transport arrangement 26. The charge unit 28 is arranged at one end portion of the transport arrangement 26, which is upstream with respect to the direction of the transport, as indicated by arrow B. The charge unit 28 has a corona 46, as well as a controller (not shown) for controlling operation of the corona 46.

The first suction unit 30 is arranged in an area, which is surrounded by the transport belt 40, and is arranged opposite the charge unit 28. The first suction unit 30 has a housing 48 having a plurality of through openings in an upper valve 50 thereof. Further, the first suction unit 30 includes an apparatus for generating negative pressure within the housing 48, as for example a blower integrated into the housing 48. Alternatively it is also possible, that the housing 48 is connected to an external source of negative pressure (not shown) in order to apply negative pressure in the housing 48.

The neutralizing unit 32 is arranged above the transport arrangement 26 at an end portion thereof, which is downstream with respect to the direction of the transport as indicated by arrow B. The neutralizing unit 32 has two coronas 52, 54, which may be controlled via a control unit (not shown).

The printing module 22 is arranged above an intermediate portion of the transport arrangement 26, between the charge unit 28 and the neutralizing unit 32. The printing module is arranged to apply a print medium, such as for example toner in a direction of the transport arrangement 26.

The second suction unit 34 is arranged in an area, which is surrounded by the transport belt 40 and is arranged opposite the neutralizing unit 32. The second suction unit has a housing 56 having through openings in an upper wall 58 thereof. The second suction unit has an apparatus for generating negative pressure in the housing 56, such as a blower 60, which, also generates a positive pressure in the first blowing unit 36, as explained in more detail herein below.

The first blowing unit 36 is directly adjacent to the second suction unit 34. The first blowing unit 36 has a housing 62 having through openings in an upper wall 64 thereof. Further, an apparatus for generating positive pressure in the housing 62, such as the blower 60, is provided. The blower 60 is arranged in such a manner, that it extends through the respective adjacent side walls of the housings 56 and 62 of the second suction unit 34 and the first blowing unit 36, respectively. Alternatively, the blower 60 could also be arranged in a connecting passage arranged between the second suction unit 34 and the first blowing unit 36.

Even though the second suction unit 34 and the first blowing unit 36 are shown to have separate housings 56, 62, these units could to be provided in a common housing having through openings in an upper wall thereof, and having a separating wall for forming separate negative pressure and positive pressure chambers.

The second blowing unit 38 is arranged within the guide roller 44, which is formed as a hollow shaft. The second blowing unit 38 has a V-shaped wall element 66, which is arranged in a stationary manner within the guide roller 44.

The V-shaped wall element 66 is arranged, such that it's opening faces the inner circumference of the hollow cylindrical body of the guide roller 44. The stationary V-shaped wall element is arranged with a small distance with respect to the inner circumference of the hollow cylindrical body and forms together therewith a chamber 68. Positive pressure may be applied to the camber 68 by means of a source of positive pressure (not shown) such as a blower.

Operation of the printing machine 20 will be described with reference to FIG. 3 herein below.

The transport belt 40 will be driven by the guide roller 42 and/or the guide roller 44 in the direction of transport as indicated by arrow B.

Then, a sheet (not shown) will be placed on a right-hand end of the transport belt 40 according to FIG. 3. This may be achieved by any suitable feed mechanism. On the transport belt the sheet will be moved towards the left in FIG. 3 along the direction of transport.

In the first suction unit 30 negative pressure is present in the housing 48, such that air will be sucked into the housing 48 via the upper wall 50. In so doing air will partially be sucked through the air permeable transport belt 40. When the sheet enters into the vicinity of the suction unit 30, the sheet will be sucked towards the transport belt 40 in this area, such that it will contact the same in a flat and small manner.

If the belt is then moved past the charge unit 28, the charge unit 28 applies electrical charges to the transport belt 40, in order to generate electrostatic holding forces between the transport belt 40 and the sheet. Since the sheet contacts the transport belt 40 in a flat and small manner, the electrostatic holding forces act substantially on the whole sheet, which is thus held on the transport belt 40 in a safe manner.

During a continued movement of the transport belt 40, the sheet is moved from the vicinity of the suction unit 30, such that electrostatic holding forces only hold it. Thereafter, the sheet enters the area of the printing module 22. In this area, assuming that the printing module 22 is using an electrophotographic printing process, a toner image is generated on said sheet. Even though FIG. 3 only shows a single printing module 22, it should be noted that obviously a plurality of printing modules 22 may be provided, in order to for example apply different color images, to generate a multi-color image.

After applying the toner image, the sheet enters the area of the second suction unit 34. In the housing 50 of the suction unit 34 again, negative pressure is applied so that air is sucked into the housing via the upper wall 58 and through the transport belt 40. When the sheet enters this area, it is again sucked to the transport belt 40. In this area also the neutralizing unit 32 is arranged, which now neutralizes electrical charges on said transport belt. This may be achieved by applying an alternating electrical field via the coronas 52, 54. Due to neutralization of the electrical charges the electrostatic holding forces are in substance removed.

Upon further movement of the sheet, the sheet enters the area of the first blowing unit 36. In the housing 62 of the first blowing unit positive pressure is present such that air is blown through the upper wall 64 and through the transport belt 40. Therefore, the sheet, as soon as it enters the area of the first blowing unit is lifted off the transport belt 40. Movement of the sheet away from the transport belt 40 is limited by the guide element 70. In this lifted off condition, the sheet could be transferred to a subsequent transport arrangement.

In the example shown in FIG. 3, however, the sheet is only shortly lifted by the blowing unit 36 and is then further moved by the transport belt 40, until it reaches the area of the guide roller 44. In this area a second blowing unit 38 is arranged within the hollow cylindrical body of the guide roller 44. In the chamber 68 of the second blowing unit 38 again positive pressure is present, such in that air is blown through the through openings in the hollow cylindrical body of the guide roller and through the transport belt 40. The outward blowing of air is limited to the circumferential area of the hollow cylindrical body, which together with a V-shaped wall element 66 forms the chamber 68. In this manner the sheet is blown such that it is completely removed from the transport belt 40 and may be transferred to a subsequent transport mechanism.

The skilled person will note that depending on the application the first or second blowing unit may be dispensed with.

Figure 4:
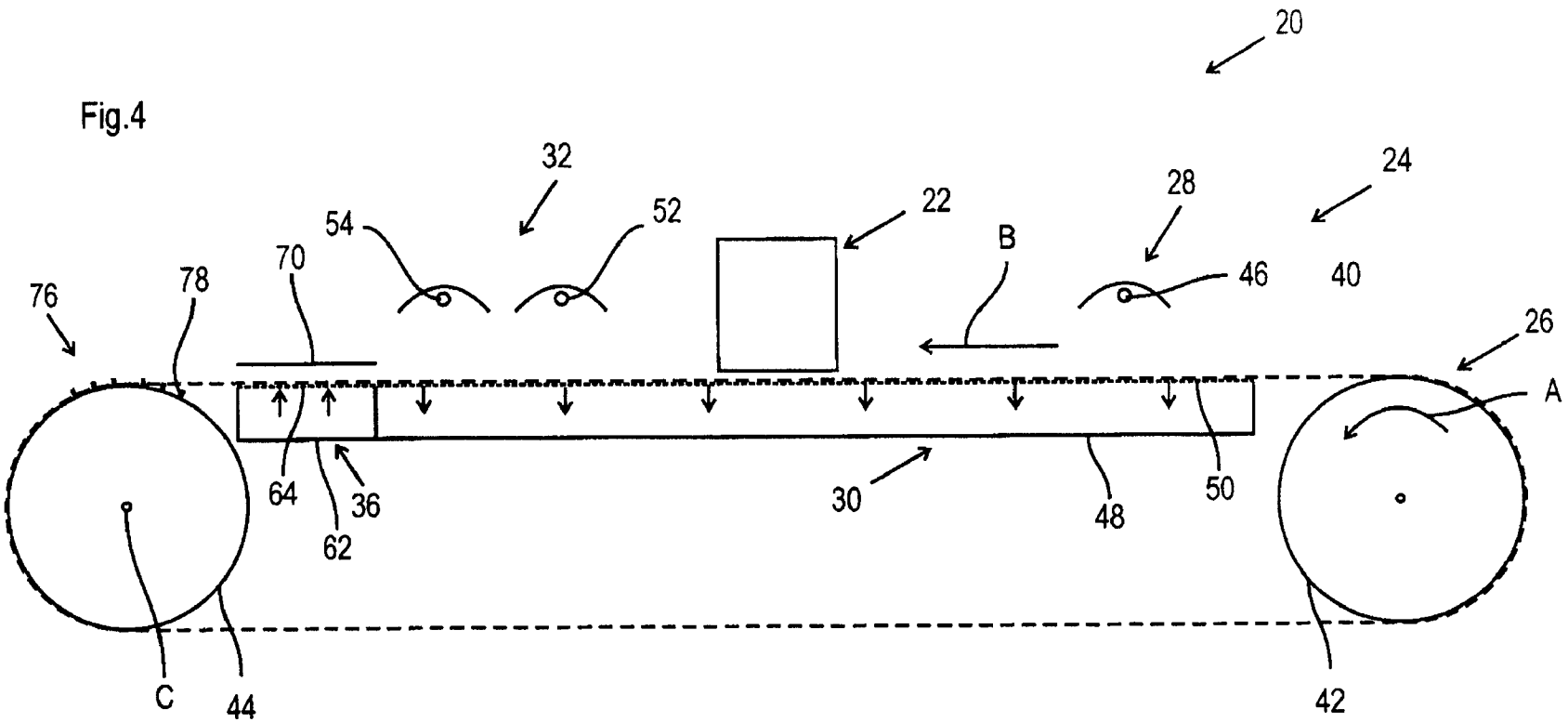
FIG. 4 shows a schematic side-view of a further printing machine having a transport apparatus according to a third example.

FIG. 4 shows a schematic side view of an alternative printing machine 20 having a printing module 22 and a transport apparatus 24. In FIG. 4 the same reference signs as used in FIG. 3 will be used, for similar or equivalent elements.

The printing module 22 according to FIG. 4 may be of any suitable type for applying a print medium. The arrangement according to FIG. 4 is particularly useful for a printing module of the inkjet type. In the following description, it will be assumed that the printing module 22 according to FIG. 4 is a printing module using an inkjet printing process.

The transport arrangement 24 has a transport unit 26, a charge unit 28, a suction unit 30, a neutralizing unit 32 as well as a blowing unit 36. In contrast to the transport arrangement 24 according to FIG. 3, no second suction unit and no second blowing unit are provided. Instead of the second blowing unit, the transport apparatus 24 according to FIG. 4 provides a mechanical lifting unit 76, which will be explained in more detail herein below.

The transport unit 26 includes a transport belt 40 which is guided around two separated guide rollers 42, 44, at least one of which is coupled to a drive mechanism.

The transport belt 40 is of the suction belt type, which is at least partially air permeable. In particular, the transport belt 40 of this example includes through openings, which on the one hand are used to achieve air permeability and on the other hand are used for receiving lifting elements there through.

The guide roller 42 has the same structure as the guide roller 42 according to FIG. 3. The guide roller 44 is not formed as hollow shaft. It may rather have the same structure as the guide roller 42. Additionally, however, the guide roller 44 also has a plurality of projections 78, only six are schematically shown in FIG. 4, provided on a circumference thereof. Even though only six projections 78 are shown, projections 78 are provided on the complete circumference of the guide roller 44 and also, several projections 78 may be provided behind each other in the plane of the drawing sheet. These may for example be arranged on a straight line behind each other. The projections 78 are arranged in such a manner, that they are aligned with a pattern of the through openings in the transport belt 40, when the transport belt 40 is guided around the guide roller 44. Thus, the projections 78 automatically engage the corresponding through openings of the transport belt upon rotation of the guide roller 44, as schematically shown in FIG. 4. The protections 78 have a height, which is larger than the thickness of the transport belt 40, such that the projections 78 may extend through the corresponding through openings and project above an outer surface of the transport belt 40. The guide roller 44 together with its projections 78 thus forms the lifting unit 76.

Similar to the example of FIG. 3, the sample of FIG. 4 also provides for a charge unit 28 above the transport unit 26. The charge unit is arranged at a first end of the transport belt, which with respect to the direction of transport is at an upstream end thereof. Further, the suction unit 30 is provided which is arranged in an area, which is surrounded by the transport belt 40, and which is arranged opposite said charge unit 28. The first suction unit has a housing 48 having a plurality of through openings formed in an upper wall 50 thereof. In contrast to the example of FIG. 3, the suction unit 30 extends over a larger portion in the direction of transport of the transport belt 40. In particular, a suction unit 30 extends to an area under the neutralizing unit 32. As previously described, a negative pressure source (not shown)

The neutralizing unit 36 has the same structure as the previously described one and is arranged at an end portion of the transport belt, which with respect to the direction of transport is at an downstream end thereof.

The printing module 22 is again arranged above a middle portion of the transport unit between the charge unit 28 and the neutralizing unit 32, in order to apply the print medium, here in particular ink, towards the transport belt 40.

The blowing unit 36 according to FIG. 4 has substantially the same structure as the blowing unit 36 according to FIG. 3. In the example according to FIG. 4, however, no blower 60 is provided between a suction unit and the blowing unit. However, a different unit (not shown) for generating positive pressure in the housing 56 of the blowing unit 36 is provided.

As previously explained, the example according to FIG. 4 does not provide a second blowing unit in the area of the guide roller 44. It is, however, noted, that as previously described, such a second blowing unit could be provided. In this case the guide roller would again be formed as a hollow shaft having through openings in a hollow cylindrical body thereof. The through openings could extend through the projections 78 or could be provided there between. The hollow cylindrical body could also be formed of a porous air permeable material.

Operation of the printing machine 20 according to FIG. 4 will be explained herein below. The transport belt 40 is again driven by a guide roller 42 and/or the guide roller 44 in a transport direction, as indicated by arrow B. Then, a sheet is placed on a right hand side of the transport belt 40.

In the housing 48 of the suction unit 30 negative pressure is present such that air is sucked through the transport belt 40 and the upper wall 50 into the housing 48. When the sheet, which is placed on the transport belt 40 enters the area of the suction unit 30, it is sucked flat against the transport belt 40.

In the area of the charge unit 28, electrical charges are applied to the transport belt 40, in order to tack the sheet by means of electrostatic holding forces to the transport belt 40.

Subsequently, the sheet, due to the movement of the transport belt 40 comes to the printing module 22, which in this example is a printing module using an inkjet printing process. In contrast to the sample of FIG. 3, the sheet is sucked to the transport belt 40 by the suction unit 30 during the whole transportation thereof and also in the area of the printing module 22. Thereby, the sheet is fixed by electrostatic holding forces as well as by negative pressure. In the area of the printing module 22, ink for generating a printed image is applied to the sheet. Inasmuch as ink often includes water, it is at least partially conductive. Therefore, the electrostatic holding forces between the sheet and the transport belt 40, at least in the area, where ink is applied, may be lost. Therefore, in the example according to FIG. 4, the sheet is not only held by electrostatic holding forces but also by negative pressure in the area of the printing module and thereafter. It is noted, that it is possible to not apply negative pressure to the sheet in the specific area where the ink is applied to the sheet, in order to avoid that the suction and any possible air flow through the sheet influences the printing process. This may for example be achieved by not providing through openings in the upper wall 50 of the suction unit 30 in the area, where ink is applied to the sheet. This area may be limited to several centimeters, in order to ensure that the sheet is at all times sucked to the transport belt before and/or behind the actual area where the ink is applied.

After applying the ink, the sheet reaches the area of the neutralizing unit 32, in which any remaining electrical charges on the transport belt are, as previously described, at least partially neutralized. Thereafter, the sheet comes into the area of the blowing unit 36 in which it is partially removed. Then, the sheet is moved to the deflection area of the transport belt 40, where it is lifted off the transport belt 40 by the projections 78 extending through the transport belt 40, in order to be received by a further transport unit.

The invention was discussed with respect to specific examples referring to the drawings, without being limited to the specific examples. It is noted, that it is possible to freely exchange and/or combine features of the separate examples, as along as those features are compatible. The scope of the invention is defined by the following claims. The invention has been described in detail with particular reference to certain preferred embodiments thereof, but it will be understood that variations and modifications can be effected within the spirit and scope of the invention.

The invention claimed is:

1. A method of transporting a sheet in a printing machine via a transport belt circulating in a direction of transport, wherein a sheet contact surface of the circulating transport belt is made an electrically non-conducting material, the method comprising:

placing a sheet on an area of the transport belt;

holding the sheet to the circulating transport belt by applying electrical charges to the area of the transport belt, for generating an electro-static holding force, between the circulating transport belt and the sheet, and by negative pressure applied through the belt;

moving the sheet a predetermined distance by the circulating transport belt;

wherein during a portion of the predetermined distance, negative pressure is not applied through belt;

subsequent neutralization by at least partially neutralizing the electrical charges on the sheet after the sheet is past the predetermined distance;

wherein towards the end of the movement of the sheet past the predetermined distance and before neutralizing the charge, the sheet is again held to the transport belt by the negative pressure applied through the belt.

2. The method according to according to claim 1, wherein pressurized air is applied to the sheet through the transport belt to detach the sheet.

3. The method according to claim 2, wherein the pressurized air is applied after neutralizing the charges.

4. The method according to claim 2, wherein the pressurized air is applied in a deflection area of the transport belt.

5. The method according to claim 4, wherein the pressurized air is applied via a guide roller of the transport belt.

6. The method according to claim 1, wherein movement of the sheet perpendicular to the surface of the transport belt is limited during the holding step.

7. The method according to claim 1, further comprising a lifting step wherein the sheet is lifted from the transport belt by means of lifting elements extending locally through the transport belt.

8. The method according to claim 1, the printing machine comprising a printing step wherein the sheet is transported along the at least one printing module and wherein the printing module applies a print medium to the sheet during the transport of the sheet.

9. The method according to claim 8, wherein the print medium is applied in accordance with an electro-photographic printing process.

10. The method according to claim 9, wherein during the printing step the print medium the sheet is not held to the transport belt by negative pressure.

11. The method according to claim 8, wherein the print medium is applied in accordance with an inkjet printing process.

12. The method according to claim 11, wherein during the printing step the sheet is held to transport belt during application of the print medium by electrostatic holding forces and negative pressure.

13. The method according to claim 11, wherein during the printing step the print medium is applied to the sheet in an area in which the sheet is not held to the transport belt by negative pressure.

14. A transport apparatus for transporting a sheet in a printing machine, the transport apparatus comprising:

a transport belt of the suction belt type comprising air permeable openings;

a drive unit for moving the transport belt along a closed loop path;

a charge unit for applying electrical charges to the transport belt, wherein the charge unit is oriented in such a manner, that it applies charges to the transport belt in the area of the suction unit at least one neutralizing unit for neutralizing electrical charges on the transport belt, wherein the neutralizing unit is arranged along the closed loop path downstream with respect to the charge unit;

a suction unit adjacent the transport belt in an area, the suction unit being arranged to enable a sheet located on the transport belt to be held thereto through the transport belt such that the suction unit extends along the circulating path at least over a portion extending from the charge unit to the neutralizing unit; and at least one further suction unit, the further suction unit being arranged, to allow a sheet on the transport belt to be held thereto through the transport belt, and arranged along the circulating path downstream with respect to the one suction unit wherein the further suction unit is arranged in an area in which the neutralizing unit neutralizes charges on the transport belt.

15. The apparatus according to claim 14, wherein at least one blowing unit is provided, the blowing unit being arranged such that it may blow through the transport belt onto a sheet placed thereon.

16. The apparatus according to claim 15, wherein the blowing unit is arranged along the closed loop path downstream with respect to the neutralizing unit.

17. The apparatus according to claim 16, wherein the blowing unit includes a roller having a hollow cylindrical body having radially extending through openings, the transport belt being guided around the roller.

18. The apparatus according to claim 17, wherein a sheet guide element is provided, which is arranged adjacent a surface of the transport belt facing away from the blowing unit, and being arranged in the area of the blowing unit.

19. The apparatus according to claim 18, wherein the sheet guide element is spaced from the surface of the transport belt facing away from the blowing unit with a distance of smaller than approximately 0.5 cm.

20. The apparatus according to claim 19, wherein the transport belt has through openings, and wherein a lifting element having protrusions is provided, wherein the lifting element is arranged in such a manner, that the protrusions may extend locally through the through openings of the transport belt.

21. The apparatus according to claim 20, wherein the lifting element is arranged along the closed loop path downstream with respect to the neutralizing unit.

22. The apparatus according to claim 21, wherein the lifting unit includes a rotatable roller, having the protrusions on an outer circumference thereon, the transport belt being guided around the roller.

23. The apparatus according to claim 22, wherein the transport belt has through openings, each having a sectional area of smaller than approximately 1 $mm^2$.

* * * * *